US008991948B2

(12) United States Patent
Marsters et al.

(10) Patent No.: US 8,991,948 B2
(45) Date of Patent: Mar. 31, 2015

(54) ACCESSIBLE CABINETRY SYSTEM

(71) Applicants: Monti Marsters, Lawrenceville, GA (US); Everett Larry Marsters, Scio, OR (US); Don Marsters, Sheridan, OR (US)

(72) Inventors: Monti Marsters, Lawrenceville, GA (US); Everett Larry Marsters, Scio, OR (US); Don Marsters, Sheridan, OR (US)

( * ) Notice: Subject to any disclaimer, the term of this patent is extended or adjusted under 35 U.S.C. 154(b) by 0 days.

(21) Appl. No.: 14/082,041

(22) Filed: Nov. 15, 2013

(65) Prior Publication Data

US 2014/0191641 A1 Jul. 10, 2014

Related U.S. Application Data

(62) Division of application No. 13/734,948, filed on Jan. 5, 2013.

(51) Int. Cl.
*A47B 67/02* (2006.01)
*A47B 46/00* (2006.01)

(52) U.S. Cl.
CPC ..... *A47B 46/005* (2013.01); *A47B 46/00* (2013.01)
USPC ..... 312/247; 312/301; 312/319.8

(58) Field of Classification Search
None
See application file for complete search history.

(56) References Cited

U.S. PATENT DOCUMENTS

| | | | | | |
|---|---|---|---|---|---|
| 617,965 | A * | 1/1899 | Lippincott et al. | 108/102 |
| 2,555,254 | A * | 5/1951 | Stebbins | 312/319.7 |
| 3,734,588 | A * | 5/1973 | Ellis | 312/247 |
| 5,203,619 | A * | 4/1993 | Welsch et al. | 312/247 |
| 5,224,677 | A * | 7/1993 | Close | 248/292.11 |
| 5,586,816 | A * | 12/1996 | Geiss, II | 312/301 |
| 5,758,782 | A * | 6/1998 | Rupert | 211/99 |
| 6,247,771 | B1 * | 6/2001 | Miller | 312/310 |
| 6,484,893 | B1 * | 11/2002 | Tkatch | 211/94.02 |
| 6,755,492 | B1 * | 6/2004 | Hyde et al. | 312/247 |
| 7,341,054 | B2 * | 3/2008 | Kuttalek | 126/19 M |
| 7,770,986 | B1 * | 8/2010 | Simaitis | 312/247 |
| 8,052,230 | B2 * | 11/2011 | Vicek | 312/247 |
| 8,157,108 | B1 * | 4/2012 | Waldrop | 211/1.57 |
| 8,414,093 | B2 * | 4/2013 | Moran | 312/248 |
| 8,424,983 | B1 * | 4/2013 | Strauss et al. | 312/247 |
| 2006/0066188 | A1 * | 3/2006 | Crawford | 312/247 |
| 2007/0236114 | A1 * | 10/2007 | Fuentes | 312/246 |
| 2008/0315737 | A1 * | 12/2008 | Hammond | 312/242 |
| 2011/0221317 | A1 * | 9/2011 | Bruestle et al. | 312/247 |
| 2012/0313494 | A1 * | 12/2012 | Chow | 312/298 |

FOREIGN PATENT DOCUMENTS

| | | | | |
|---|---|---|---|---|
| CH | 609545 A * | 3/1979 | | A47B 51/00 |
| DE | 3215572 A1 * | 10/1983 | | A47B 77/02 |
| DE | 19923494 C1 * | 1/2001 | | A47B 46/00 |

* cited by examiner

*Primary Examiner* — Hanh V Tran
(74) *Attorney, Agent, or Firm* — Steven Fisher-Stawinski; Robert W. Gray; The Gray Law Group, Ltd

(57) ABSTRACT

A high cabinet may be mechanically lowered to within reach of a disabled user. In the second exemplary embodiment, a scissor-jack type mechanism pushes an outer cabinet out from the wall and a sliding mechanism allows an inner cabinet to drop down from within the outer cabinet.

7 Claims, 2 Drawing Sheets

FIG. 1
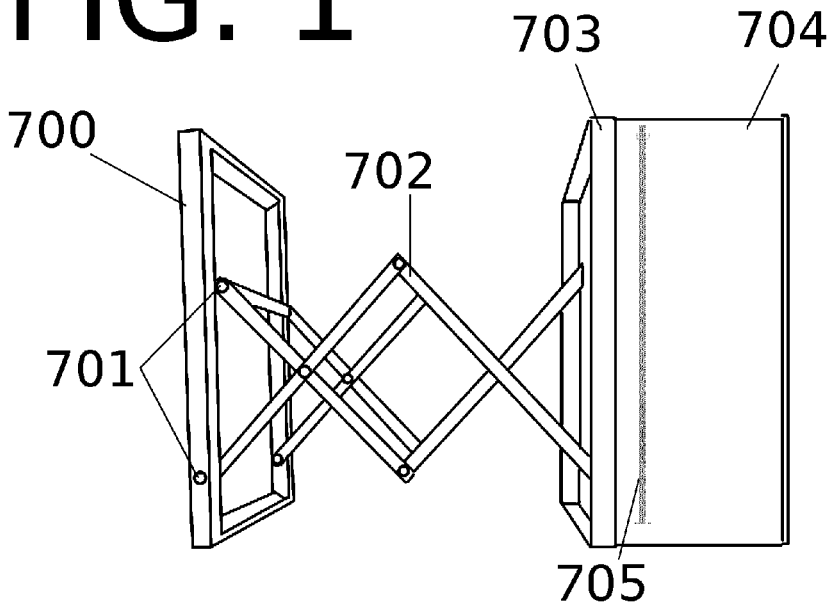
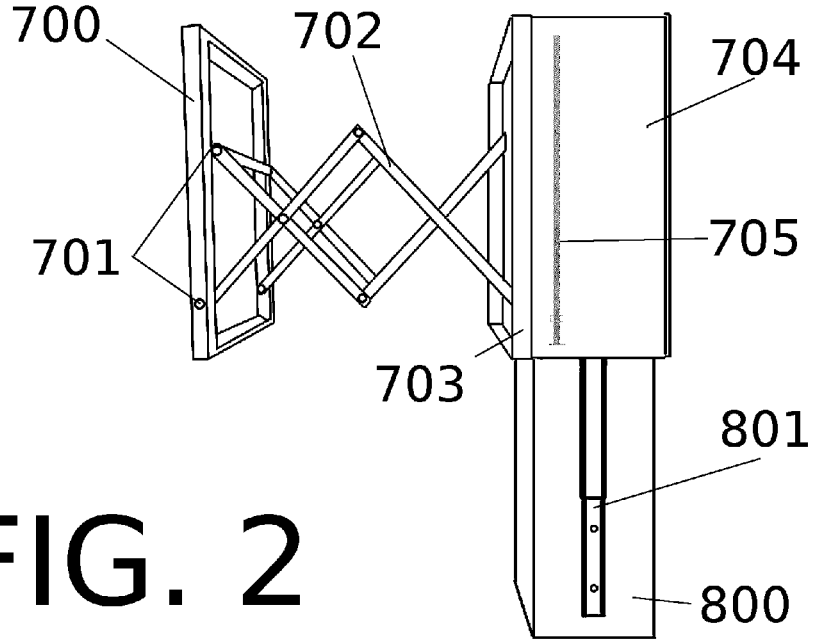
FIG. 2

ACCESSIBLE CABINETRY SYSTEM

CROSS-REFERENCE TO RELATED APPLICATIONS

This application is a division of U.S. Non-Provisional Utility patent application Ser. No. 13/734,948, filed Jan. 5, 2013, now abandoned, which is hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to cabinetry and in particular to mechanized cabinetry wherein a high cabinet may be lowered to be within reach of a disabled user, such as a user confined to a wheelchair. Conventional fixed cabinets, when located high up, are typically only within reach of a standing adult and are therefore completely inaccessible to wheelchair-bound individuals. At the same time, conventional fixed cabinetry provides a well-known solution for the use of storage space near the ceiling within a living area. To provide disabled users the ability to use storage space near the ceiling, a useful device would provide a cabinet that temporarily lowers itself and its contents to within reach of a disabled user in a manner that is safe, gentle, and reliable. While some moving cabinet designs exists, these systems are generally limited by the requirement that an area of countertop be kept completely clear; an improved device would allow for whole or partial region of the countertop below the cabinet to be used for storage of frequently needed items or for active use in food preparation, during which the user might wish to access the contents of the cabinet.

SUMMARY OF THE INVENTION

Accordingly, the invention is directed to a system of mechanized cabinetry wherein a high near-ceiling cabinet may be mechanically lowered to within reach of a disabled user. Three exemplary embodiments are provided. In the first exemplary embodiment, an otherwise ordinary cabinet having otherwise ordinary doors is attached to a wall by two sets of rotatable lever arms, which allow the cabinet to be translationally moved between a raised position against a wall and a lowered position out from the same wall, optionally resting on a countertop. In the second exemplary embodiment, a scissor-jack type mechanism pushes an outer cabinet out from the wall and a sliding mechanism allows an inner cabinet to drop down from within the outer cabinet. In the third exemplary embodiment, a single cabinet is mounted between a pair of vertically sliding plates, which are mounted between a pair of horizontally sliding plates.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate the invention and, together with the description, serve to explain the principles of the invention.

FIG. 1 shows a side view of the second exemplary embodiment in extended and raised position.

FIG. 2 shows a side view of the second exemplary embodiment in extended and lowered position.

DETAILED DESCRIPTION OF THE INVENTION

Referring now to the invention in more detail, the invention is directed to a system of mechanized cabinetry wherein a storage cabinet may be lowered from a raised storage position to a lowered loading and unloading position within reach of a user, for example a disabled user confined to a wheelchair. In each of several exemplary embodiments, an independent cabinet enclosure having a top, bottom, back, front, left side, and right side is allowed to move translationally guided by a support mechanism between the raised storage position and the lowered loading and unloading position. In each embodiment, the support mechanism is securely fixed to a vertical support, for example affixed between two vertical wall studs of a wooden home. In each embodiment, the mechanism is powered by an electronically controlled drive mechanism, for example an electric motor or hydraulic or pneumatic cylinder system. The cabinet enclosure may optionally be of the common type found in homes wherein one or more swinging doors covers one or more openings in the front of the cabinet (with the doors optionally featuring glass or other transparent components). Optionally, in lieu of doors, a cabinet insert may slide out from the enclosure to give access to the cabinet contents; in such embodiments one or more of the fixed faces may include glass or other transparent components so that the contents can be seen. The inside of the cabinet storage area may be bare or may features shelves, drawers, hooks, rods, or other type of storage structure.

Figure 3:
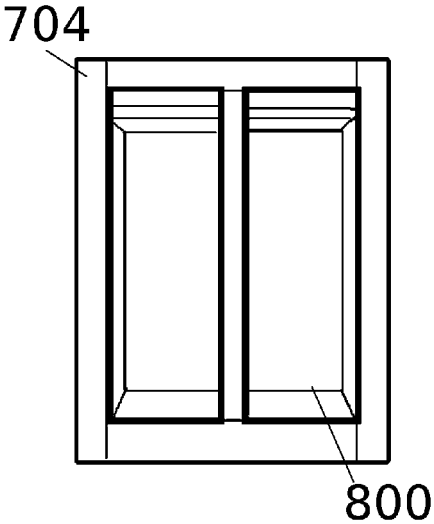
FIG. 3 shows front view of the second exemplary embodiment in raised position.
Figure 4:
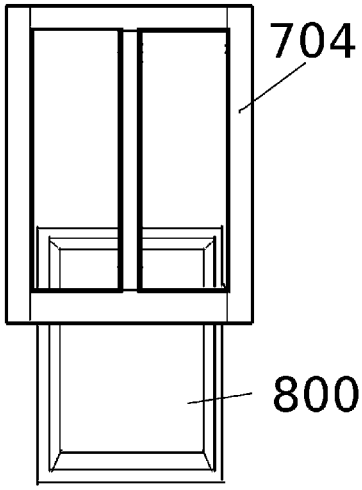
FIG. 4 shows a front view of the second exemplary embodiment in lowered position.
Figure 5:
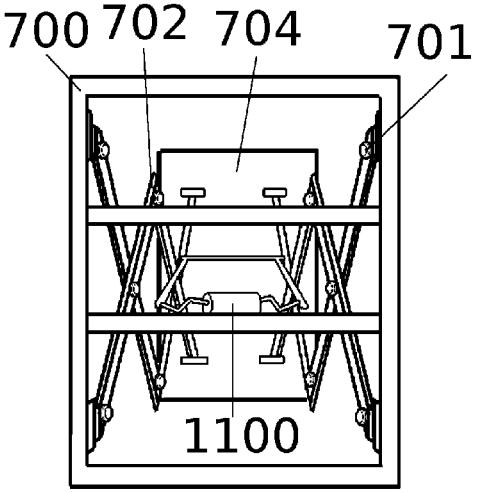
FIG. 5 shows a rear view of the second exemplary embodiment in extended position.
Figure 6:
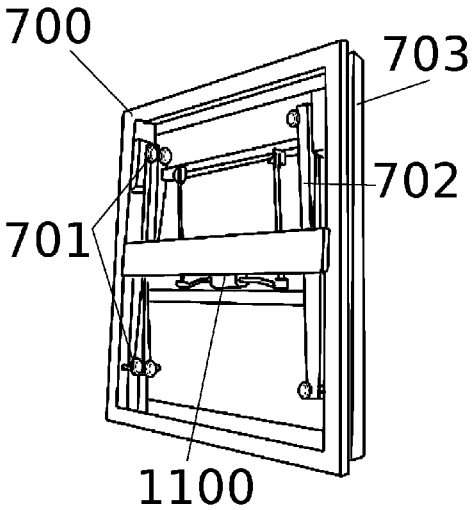
FIG. 6 shows a rear view of the second exemplary embodiment in retracted position.

Referring now to the second exemplary embodiment, FIGS. 1-6 show the second exemplary embodiment. In the second exemplary embodiment, a rigid rectangular frame 700 is mounted to a vertical support, for example between a pair of vertical wall studs. Each vertical side of the frame 700 supports a pair axles or hinges 701, preferably at least one of which (e.g the lower one) is vertically slidable. The axles or hinges rotatably support a scissor-type extension mechanism 702 wherein a plurality of opposingly angled members are rotatably fixed to one another such that the mechanism may be contracted or extended along a line of motion that is generally horizontal and orthogonal to the wall. The scissor-type extension mechanism is rotatably and slidably fixed to a rear cabinet frame 703, which surrounds the rear edges of an outer cabinet 704. The outer cabinet 704 encloses an inner cabinet 800 such that the inner cabinet may be dropped down and out of the outer cabinet 704 by vertical motion along a pair of tracks 801, each mounted on one side of the inner cabinet 800 and on the inner face of the outer cabinet 704. The scissor-type mechanism 702 is powered by a linear extension device 1100, which may be any form of actuator, for example an electric motor or hydraulic or pneumatic piston that rotates or extends to drive the scissor-mechanism 702 in its extension and retraction motion. In particular, the linear extension device 1100 may be in the form of a linear motor comprising a motor-driven lead screw, or equivalently, a lead screw having a motor movable mounted thereon. The inner cabinet 800 may likewise be driven on its tracks 801 by a linear motor 705 or other type of linear motion device. In particular, the linear extension device 705 may be in the form of a linear motor comprising a motor-driven lead screw, or equivalently, a lead screw having a motor movably mounted thereon, as shown in FIG. 2. As further shown in FIG. 2, the linear extension device 705 is directly adjacent to the track 801; this is preferably and implicitly repeated on the opposing side of the inner cabinet 800 with the other of the pair of vertical tracks 801 such that, for each vertical track 801, there is one adjacent corresponding linear extension device 705.

It should be noted that, in the second exemplary embodiment as best shown in FIG. 2, the inner cabinet 800 preferably comes to rest in its access position on or near the front edge of a countertop or other surface. This motion allows the user to store frequently used items at the rear of the counter or to lower the inner cabinet 800 over and in front of any temporary items located on the counter, for example food in the process of preparation.

It should be further noted that, in the second exemplary embodiment, the invention generally may be mechanically inverted to create a lift-cabinet rather than a drop-cabinet. This may generally be achieved by allowing the cabinet's vertical dimension of motion to go up, rather than down, and the storage position low rather than high. Each mechanism may be otherwise unmodified. The lift variant of the invention preserve's the invention's advantage of having an obstructable region behind the access position; however the obstructable region is located above, rather than below the storage position.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

We claim:

1. A mechanical cabinet system comprising:

(a) a rigid cabinet structure having at least a rear surface, left side surface, and right side surface;

(b) a vertical support;

(c) a moveable cabinet mounting means for mounting said cabinet structure to said vertical support such that said cabinet structure may be moved along a mechanically limited path between a storage position and an access position such that said mechanically limited path avoids an obstructable region located below or above said storage position and behind said access position;

(d) said cabinet structure being mounted to said vertical support by said moveable cabinet mounting means;

(e) a powered motion-generating means for selectively urging said cabinet structure between said storage position and said access position; and (f) said powered motion-generating means being mechanically affixed to any combination of said cabinet structure, said vertical support, and said cabinet mounting means;

whereby, said cabinet structure may be selectively urged between said storage position and said access position; and wherein (g) said cabinet structure further comprises a rigid front surface and no surface on both the bottom and the top face;

(h) said moveable cabinet mounting means in part comprises a scissor-type extension mechanism having a first end and a second end;

(i) said first end of said scissor-type extension mechanism being rotatably affixed at all points and slidably affixed at at least two points to said vertical support;

(j) said second end of scissor-type extension mechanism being rotatably affixed at all points and slidably affixed at at least two points to the rear surface of said cabinet structure;

(k) said moveable cabinet mounting means in part further comprises an inner cabinet having a rigid bottom surface, a rigid top surface, and at least one open vertical side;

(l) said inner cabinet being disposed within said cabinet structure; and (m) said inner cabinet being slidably mounted to the inside surface of said cabinet structure by a plurality of vertical tracks such that said inner cabinet may be selectively moved up and down within and below or above said cabinet structure;

whereby said cabinet structure may be moved between said storage position against said vertical support and an intermediate position extended out from said vertical support, and said inner cabinet may be lowered or raised from within said cabinet structure to reach said access position.

2. The mechanical cabinet system of claim 1 wherein said powered motion generating means comprises in part a primary linear motor driving said scissor mechanism and in part a plurality of secondary linear motors driving said vertical tracks.

3. The mechanical cabinet system of claim 1 wherein said powered motion generating means comprises a hydraulic or pneumatic cylinder driving said scissor mechanism and in part a plurality of secondary linear motors driving said vertical tracks.

4. The mechanical cabinet system of claim 2 wherein each of said plurality of secondary linear motors is adjacent to one of said plurality of vertical tracks.

5. The mechanical cabinet system of claim 3 wherein each of said plurality of secondary linear motors is adjacent to one of said plurality of vertical tracks.

6. The mechanical cabinet system of claim 4 wherein said plurality of secondary linear motors and said plurality of vertical tracks are both two in number, each respectively situated within said cabinet structure on said left side surface and on said right side surface.

7. The mechanical cabinet system of claim 5 wherein said plurality of secondary linear motors and said plurality of vertical tracks are both two in number, each respectively situated within said cabinet structure on said left side surface and on said right side surface.

* * * * *